US010450663B2

(12) United States Patent
Rondinone et al.

(10) Patent No.: US 10,450,663 B2
(45) Date of Patent: Oct. 22, 2019

(54) ELECTROCHEMICAL CATALYST FOR CONVERSION OF NITROGEN GAS TO AMMONIA

(71) Applicant: UT-Battelle, LLC, Oak Ridge, TN (US)

(72) Inventors: Adam J. Rondinone, Knoxville, TN (US); Yang Song, Oak Ridge, TN (US); Dale K. Hensley, Kingston, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 15/967,615

(22) Filed: May 1, 2018

(65) Prior Publication Data

US 2018/0334753 A1 Nov. 22, 2018

Related U.S. Application Data

(60) Provisional application No. 62/531,555, filed on Jul. 12, 2017, provisional application No. 62/508,023, filed on May 18, 2017.

(51) Int. Cl.

| | |
|---|---|
| ***C25B 1/00*** | (2006.01) |
| ***C25B 11/04*** | (2006.01) |
| ***C25B 11/02*** | (2006.01) |

(52) U.S. Cl.
CPC ..... *C25B 11/0478* (2013.01); *C25B 1/00* (2013.01); *C25B 11/02* (2013.01); *C25B 11/04* (2013.01); *C25B 11/0405* (2013.01)

(58) Field of Classification Search
CPC ..... C25B 1/00
See application file for complete search history.

(56) References Cited

U.S. PATENT DOCUMENTS

| | | | | |
|---|---|---|---|---|
| 8,470,157 | B2 * | 6/2013 | Friesen | C25B 1/00 205/360 |
| 2003/0164305 | A1 * | 9/2003 | Denvir | C25B 1/00 205/360 |
| 2016/0251765 | A1 * | 9/2016 | Botte | C25B 11/0478 205/552 |

OTHER PUBLICATIONS

Xiaoxi Guo et al. "Recent progress in electrocatalytic nitrogen reduction" Journal of Materials Chemistry A. Jan. 29, 2019. vol. 7. pp. 3531-3543 (Year: 2019).*

(Continued)

*Primary Examiner* — Steven A. Friday
(74) *Attorney, Agent, or Firm* — Edna I. Gergel

(57) ABSTRACT

The invention provides a method of converting nitrogen into ammonia. The method comprises contacting an electrocatalyst with an aqueous solution of dissolved nitrogen gas. The electrocatalyst comprises carbon nanospikes doped with nitrogen.

6 Claims, 6 Drawing Sheets

(56) References Cited

OTHER PUBLICATIONS

V. Kyriakou et al. "Progress in the electrochemical synthesis of ammonia" Catalysis Today. Jun. 19, 2016 vol. 286. pp. 2-13 (Year: 2016).*
Shin-Ichiro Fujita et al. "Nitrogen-doped activated carbon as metal-free catalysts having various functions" Journal of Carbon Research. Oct. 18, 2017. vol. 3, Iss. 4. (Year: 2017).*
Leah B. Sheridan, et al., "Growth and Electrochemical Characterization of Carbon Nanospike Thin Film Electrodes," Journal of Electrochemical Society, 2014, pp. H558-H563, vol. 161, Issue 9.
Michael A. Shipman, et al., "Recent Progress Towards the Electrosynthesis of Ammonia From Sustainable Resources," Catalysis Today, 2017,pp. 57-68, vol. 286.
Yang Song, et al., "High-Selectivity Electrochemical Conversion of CO2 to Ethanol Using a Copper Nanoparticle/N-Doped Graphene Electrode," Chemistry Select, 2016, pp. 6055-6061, vol. 1.

* cited by examiner

ELECTROCHEMICAL CATALYST FOR CONVERSION OF NITROGEN GAS TO AMMONIA

CROSS REFERENCE TO RELATED APPLICATION

The present application claims benefit of U.S. Provisional Application Ser. No. 60/508,023, filed on May 18, 2017, and 62/531,555 filed on Jul. 12, 2017, all of the contents of which are incorporated herein by reference.

STATEMENT REGARDING FEDERALLY SPONSORED RESEARCH

This invention was made with government support under Prime Contract No. DE-AC05-00OR22725 awarded by the U.S. Department of Energy. The government has certain rights in the invention.

FIELD OF THE INVENTION

This invention generally relates to the field of electrocatalysis and to methods for converting nitrogen into useful products. The invention relates, more particularly, to electrocatalysts for converting nitrogen to ammonia.

BACKGROUND OF THE INVENTION

Worldwide production of ammonia exceeds 145 million metric tons per year. The Haber-Bosch process must be performed at high temperature and pressure using pure hydrogen, which is usually sourced from natural gas via steam reforming; hence ammonia production represents a significant contributor to climate change. Because of this, alternative methods for synthesizing ammonia are now of great scientific interest.

While the literature is still sparse, a number of electrocatalytic studies that produce $NH_3$ directly via electroreduction of $N_2$ and water or steam have been reported. Most studies on electrochemical production of ammonia are based on solid-state electrolytes at elevated temperature and pressure. Other studies have also been reported based on liquid electrolytes, such as organic solvents, ionic liquids, molten salts, aqueous electrolyte at elevated or ambient pressure, or fullerene electrodes with aqueous electrolyte. In these studies, transition metal complexes and materials are often exploited as the catalysts.

Aqueous electrolyte approaches promise simplicity and low cost, as the solvent water directly becomes the hydrogen source. However, aqueous electrolyte approaches suffer from competitive hydrogen evolution which limits overall efficiency. To date the highest reported Faradaic efficiency (FE) for an aqueous reaction under ambient conditions is 1.3%.

There is no report yet on alternative catalysts that allow one to abandon the conventional transition metal catalysts as a result of significant improvements of electrocatalytic performance. Thus, a more efficient and selective method for converting nitrogen into useful fuel products would represent a significant advance in the art.

SUMMARY OF THE INVENTION

In one aspect, the invention is directed to a method of converting nitrogen into ammonia. An electrocatalyst that efficiently and selectively converts nitrogen into ammonia includes carbon nanospikes doped with nitrogen.

The method entails contacting the electrocatalyst, described above, with nitrogen in an aqueous solution, while the electrocatalyst is electrically configured as a cathode. Generally, the voltage across the cathode and anode is at least 2 volts, or within 2-4 volts, or 2-3.5 volts. More particularly, the method entails contacting the above-described electrocatalyst with an aqueous solution containing dissolved nitrogen gas while the aqueous solution is in contact with a source of nitrogen gas, which replenishes the dissolved nitrogen gas as the dissolved gas is converted to ammonia at the surface of the electrocatalyst, and the electrocatalyst is electrically powered as a cathode and is in electrical communication with a counter electrode electrically powered as an anode, wherein the voltage across the cathode and anode is at least 2 volts or within a range of 2 to 3.5 volts, to convert nitrogen into ammonia.

DETAILED DESCRIPTION OF THE INVENTION

Figure 1:
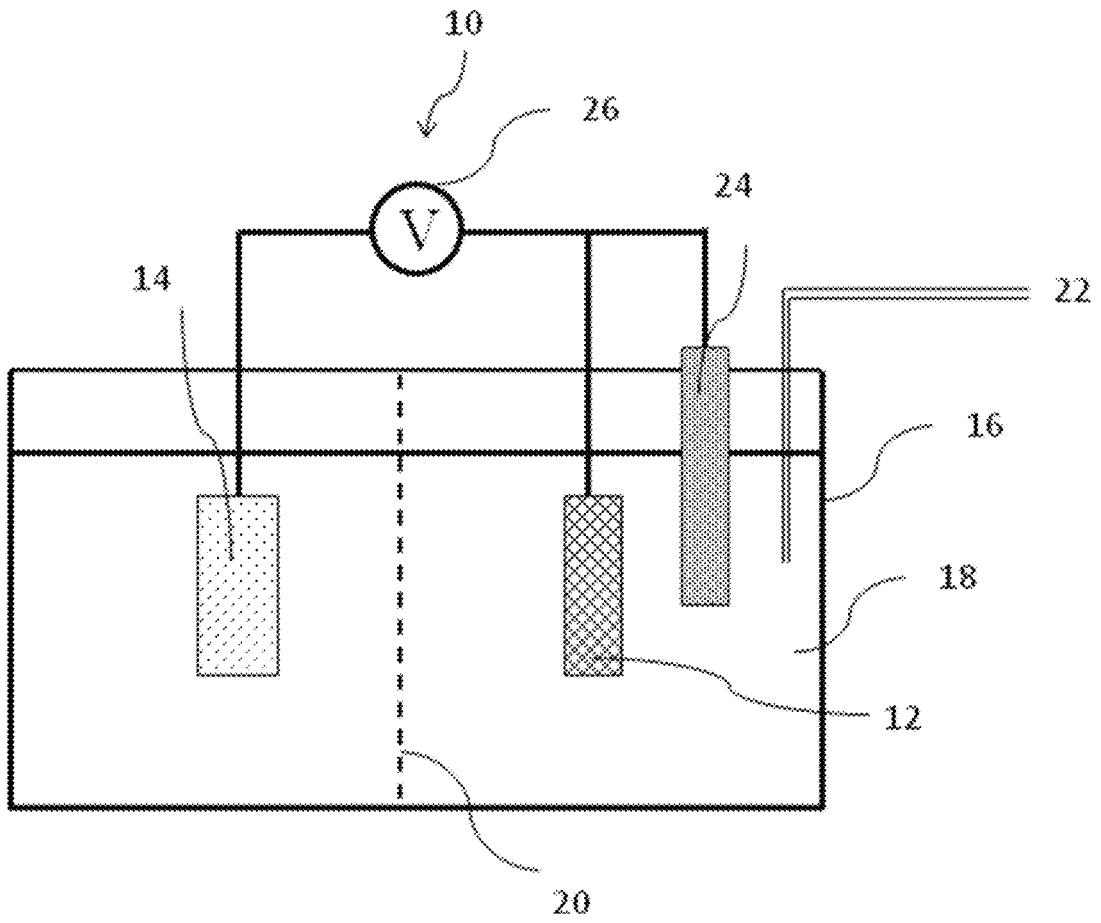
FIG. 1. A schematic diagram showing an electrochemical cell for converting nitrogen.

In one aspect, the invention is directed to a method of converting nitrogen into ammonia. The method entails contacting an electrocatalyst comprising carbon nanospikes doped with nitrogen. As used herein, the term "nanospikes" are defined as tapered, spike-like features present on a surface of a carbon film.

The carbon nanospikes in the electrocatalyst can have any length. Generally, the nanospike length may be precisely or about, for example, 30, 35, 40, 45, 50, 55, 60, 65, 70, 75, 80, 85, or 90 nm, or within a range bounded by any two of these values. In particular embodiments, the carbon nanospikes have a length of from about 50 to 80 nm.

At least a portion (e.g. at least 30, 40, 50, 60, 70, 80, or 90%) of the carbon nanospikes in the electrocatalyst is composed of layers of puckered carbon ending in a straight or curled tip. The width of the straight or curled tip may be precisely or about, for example, 0.5, 0.6, 0.7, 0.8, 1.0, 1.1, 1.2, 1.3, 1.4, 1.5, 1.6, 1.7, 1.8, 1.9, 2.0, 2.1, 2.2, 2.3, 2.4, or 2.5 nm, or within a range bounded by any two of these values. In particular embodiments, the straight or curled tip has a width of from about 1.8 to 2.2 nm.

The carbon nanospikes are doped with nitrogen. It is believed that the dopant prevents well-ordered stacking of carbon, thus promoting the formation of disordered nanospike structure. The amount of the dopant in the carbon nanospikes may be precisely or about, for example, 3, 4, 5, 6, 7, 8, or 9 atomic %, or within a range bounded by any two of these values. In particular embodiments, the dopant concentration is from about 4 to 6 atomic %.

The carbon nanospikes can be prepared by any method known to those skilled in the art. In one embodiment, the carbon nanospikes can be formed on a substrate by plasma-enhanced chemical vapor deposition (PECVD) with any suitable carbon source and nitrogen dopant source. In a first embodiment, the substrate is a semiconductive substrate. Some examples of semiconductive substrates include silicon, germanium, silicon germanium, silicon carbide, and silicon germanium carbide. In a second embodiment, the substrate is a metal substrate. Some examples of metal substrates include copper, cobalt, nickel, zinc, palladium, platinum, gold, ruthenium, molybdenum, tantalum, rhodium, stainless steel, and alloys thereof. In a particular embodiment, an arsenic-doped (As-doped) silicon substrate is employed and nitrogen-doped carbon nanospikes are grown on the As-doped silicon substrate using acetylene as the carbon source and ammonia as the dopant source. For additional details on the formation of carbon nanospikes useful in the present invention, reference is made to Sheridan et al., *J. of Electrochem. Society,* 2014, 161(9): H558-H563, the contents of which are herein incorporated by reference in their entirety.

The method of converting nitrogen into ammonia using the electrocatalyst described above includes contacting the electrocatalyst with nitrogen gas dissolved in an aqueous solution, such as water, while the electrocatalyst is electrically configured as a cathode. More particularly, the method includes contacting the above-described electrocatalyst with an aqueous solution containing dissolved nitrogen gas, the electrocatalyst is electrically powered as a cathode and is in electrical communication with a counter electrode electrically powered as an anode. A voltage is then applied across the anode and the electrocatalytic cathode in order for the electrocatalytic cathode to electrochemically convert nitrogen to ammonia.

The aqueous solution is generally formed by dissolving, in water, an electrolyte containing an alkaline earth cation. Examples of alkaline earth cations include, but are not limited to, $Li^+$, $Na^+$, and $K^+$. Examples of suitable electrolytes include $LiClO_4$, $NaClO_4$, and $KClO_4$. The minimum concentration of electrolyte is about 0.1 M, about 0.2 M, or about 0.3 M. The maximum amount of electrolyte is about 1.0 M, about 0.9 M, or about 0.8 M. Without wishing to be bound by theory, the alkaline earth cation, such as $Li^+$, pre-concentrates the $N_2$ molecules at the tips of the electrocatalyst.

The electrochemical reduction of nitrogen can be carried out in an electrochemical cell 10, as depicted in FIG. 1. The electrochemical cell 10 includes a working electrode (cathode) 12 containing the electrocatalyst described above, a counter electrode (anode) 14, and a vessel 16. The counter electrode 14 may include a metal such as, for example, platinum or nickel. The vessel 16 contains an aqueous solution of dissolved gas 18, and electrolyte and a source of nitrogen gas. The working electrode 12 and the counter electrode 14 are electrically connected to each other and in contact with the aqueous solution 18. As shown in FIG. 1, the working electrode 12 and the counter electrode 14 can be completely immersed in the aqueous solution 18, although complete immersion is not required. The working electrode 12 and the counter electrode 14 only need to be placed in contact with the aqueous solution 18. The vessel 16 includes a solid or gel electrolyte membrane (e.g., anionic exchange membrane) 20 disposed between the working electrode 12 and the counter electrode 14. The solid electrolyte membrane 20 divides the vessel 16 into a working electrode compartment housing the working electrode 12 and a counter electrode compartment housing the counter electrode 14.

The electrochemical cell 10 further includes an inlet 22 through which nitrogen gas flows into the aqueous solution 18. The nitrogen gas is made to flow into the aqueous solution 18 at a rate that allows sufficient nitrogen gas transport to the surface of the working electrode 12 while preventing interference from gas bubbles striking the electrode surface. The flow rate of the nitrogen gas is generally dependent on the size of the working electrode. In some embodiments, the flow rate may be about, at least, or up to, for example, 3, 10, 30, 50, 70, 90, 100, 120, 140, 160, 180, or 200 mL $min^{-1}$, or within a range bounded by any two of these values. However, for larger scale operations using larger electrodes, the flow rate could be much higher. In some embodiments, before introducing the nitrogen gas into the vessel 16, the nitrogen gas may be humidified with water by passing the gas through a bubbler to minimize the evaporation of the electrolyte. The nitrogen being converted may be produced by any known source of nitrogen. The source of nitrogen may be, for example, any gas containing nitrogen gas. In one embodiment, the gas is pure nitrogen gas.

In some embodiments, the electrochemical cell shown in FIG. 1 is a three-electrode cell that further includes a reference electrode 24 for the measurement of the voltage. In some embodiments, a reference electrode is not included. In a particular embodiment, a silver/silver chloride (Ag/AgCl) or reversible hydrogen electrode (RHE) is used as the reference electrode 24.

Typically, a negative voltage and a positive voltage are applied to the working electrode 12 and the counter electrode 14, respectively to convert nitrogen to ammonia. Generally, the negative voltage applied to the working electrode 12 may be precisely or about, for example, −0.5, −0.7, −0.9, −1.0, −1.2, −1.4, −1.5, −1.7, −2.0, −2.1, −2.5, −2.7, or −3.0 V with respect to a reversible hydrogen electrode (RHE), or within a range bounded by any two of these values. Generally, the voltage across the working electrode 12 (i.e., cathode) and the counter electrode 14 (i.e. anode) is at least 2 V, or within 2-4 V, or within 2-3.5 V, or within 2-3 V, for converting the nitrogen into ammonia. The voltage can be applied by any method known to those skilled in the art. For example, the voltage can be applied using a potentiostat 26.

The method for converting nitrogen to ammonia described above can advantageously operate at room temperature and in water, and can be turned on and off easily.

Examples have been set forth below for the purpose of illustration and to describe certain specific embodiments of the invention. However, the scope of this invention is not to be in any way limited by the examples set forth herein.

EXAMPLES

Example 1: Preparation of Carbon Nanospikes

CNS were prepared by plasma-enhanced chemical vapor deposition (PECVD). The CNS can be grown on any conductive surface. In this work, n-type 4-inch Si wafers <100> with As doping (<0.005Ω) were used as substrates. DC plasma was generated between the substrate (cathode) and the showerhead (anode) in a continuous stream of $C_2H_2$ and $NH_3$ gas, flowing at 80 sccm and 100 sccm respectively, at 650° C. for 30 min. The total pressure was maintained at 6 Torr with a plasma power of 240 W.

Example 2: Electrode Preparation

To prepare the electrode from CNS grown on Si wafer, the surface of CNS was gently scratched at the edge of a piece of cleaved 1.0×1.5 $cm^2$ CNS-coated wafer, and a small piece of indium metal (Alfa Aesar, >99.99%) was pressed on the scratch to produce an ohmic contact. Then, silver paste (Ted Pella) was used as conductive glue between a copper wire and the indium pad. The edges and backside of the samples were protected by epoxy to isolate them from contacting the electrolyte.

Example 3: Electrochemistry

An H-shape electrochemical cell with a porous glass frit to separate the working and counter electrode compartments was employed for $N_2$ electrocatalytic experiments. The cell maintained the working electrode parallel to the counter electrode to achieve a uniform voltage. $N_2$ (Praxair), regulated by a mass flow controller (MKS Instruments) at 20 mL $min^{-1}$, flowed through the cell during the electrolysis. $N_2$ flow through the cell was needed to see large current efficiencies for $N_2$ reduction products, presumably because of mass transport limitations in a quiescent cell. The flow rate of 20 mL $min^{-1}$ was chosen to ensure sufficient $N_2$ transport to the surface while preventing interference from gas bubbles striking the surface. The $N_2$ was humidified with water by passing it through a bubbler before it entered the electrolysis cell in order to minimize the evaporation of electrolyte. For each electrolysis experiment, the cell was assembled with CNS as the working electrode and platinum as the counter electrode. An Ag/AgCl electrode was used as the reference. A 0.25 M solution of $LiClO_4$ (Aldrich, 99.99% metals basis) was prepared with 18.2 MΩ-cm deionized water from a Millipore system and used as the electrolyte. Each compartment of the H-cell contained 12.5 mL of electrolyte. As a control, identical experiments were conducted using other aqueous electrolytes containing $NaClO_4$ and $KClO_4$.

All electrochemical results are reported using the electrochemical surface area (ECSA). Electrolysis was carried out with a Biologic VSP potentiostat (VMP3), using chronoamperometry (CA) method. Conversion of electrode potential vs. RHE was calculated by $E_{RHE}=E_{Ag/AgCl}+0.059*pH+E^{\circ}_{Ag/AgCl\ (Sat.)}$. EC-Lab software was used to link different techniques without returning to open circuit for each electrolysis experiment. In order to generate detectable amounts of products, the electrolysis potential was applied for 6 hours in a typical experiment and for 100 hours for the stability test.

Example 4: Product Quantification

The ammonia quantification protocol was adapted from EPA Standard Method 350.1. The protocol was applied to the electrolyte after electrolysis to determine and confirm the ammonia formed from $N_2$ reduction. Typically, 1.5 mL electrolyte was pipetted into a glass vial. Then, 100 μL 500 mM phenol and 50 μL 2 mM sodium nitroprusside aqueous solution were added, followed by 100 μL 700 mM sodium hypochlorite with 1 M NaOH aqueous solution. The mixture was gently agitated for 30 s and was then allowed to stand for 30 min to ensure complete color development. The absorbance at 640 nm was measured with a UV-Vis spectrometer (Varian Cary 5000).

In order to account for ammonia in the electrochemical cell headspace, the cell exhaust gas was passed through a 15 mL 0.5 M $H_2SO_4$ solution to strip gaseous ammonia, if any. The pH of the solution in the acidic trap was firstly adjusted to neutral with 1 M NaOH, and then the ammonia quantification protocol as described above was employed to quantify the trapped ammonia from the overhead space of the electrochemical cell. Every sample was analyzed in this manner, however no ammonia was detected indicating that the product remained dissolved in the electrolyte.

A modified ammonia quantification protocol was identical to the above described method, except that o-phenylphenol was used instead of phenol. This resulted in a dye that was soluble in hexanol, in order to extract the dye from the electrolyte for GC/MS analysis of isotopically labelled $NH_3$.

Absorbance measurements were calibrated by regression analysis of data obtained with standard ammonium-nitrogen solutions with concentration of 0, 2, 5, 10, 20, 50, 100, 250, 500 μM $NH_3$—N $L^{-1}$ in $LiClO_4$ aqueous solutions. Firstly, a concentrated standard ammonium-nitrogen solution containing 5 mM was prepared by dissolving 0.2675 g ammonium chloride in 500 mL 0.25 M $LiClO_4$ solution in a volumetric flask. Working standards were prepared by diluting the concentrated standard with 0.25 M $LiClO_4$ solution to obtain desired concentrations. Then the ammonium chloride was converted to indophenol as described above, and the absorbance was measured at 640 nm by UV-Vis spectrometer. Regression equations were used to convert absorbance values for electrolyte to $NH_3$—N concentrations. Two regression equations were obtained to determine low concentration samples (0-50 μM) and high concentration samples (0-500 μM). The slope is 0.00296 $\mu M^{-1}$ for low concentration samples, and 0.00291 $\mu M^{-1}$ for samples with higher $NH_3$—N concentration.

The rate of ammonia formation was calculated using the following equation:

$$R_{NH_3} = \frac{[NH_3] \times V}{t \times A}$$

where $[NH_3]$ is the measured $NH_3$ concentration, V is the volume of the electrolyte, t is the electrolysis time and A is the electrochemical surface area of the working electrode.

To test the stability of the electrolysis on CNS, the formation of $NH_3$ was monitored over 100 h. After a period of time, e.g., 0.5, 1, 2 or 4 h, 1.5 mL of the electrolyte was sampled by a syringe followed by introducing 1.5 mL degassed $LiClO_4$ into the cell to maintain the electrolyte level in the electrochemical cell. The concentration of $NH_3$ was determined by the quantification protocol described above. The rate of ammonia formation at the time of sampling was calculated using the following equation:

$$R_{NH_{3_n}} = \frac{[NH_3]_n \times V + \Sigma_{i=1}^{n-1}[NH_3]_i \times 1.5\ \text{mL}}{t_n \times A}$$

where n is the serial number of sampling, $[NH_3]_n$ is the measured $NH_3$ concentration, V is the volume of the electrolyte in the cell, $t_n$ is the total time from the beginning to sampling, and A is the electrochemical surface area of the working electrode.

Example 5: Mass Spectrometry of $^{15}N$ Product

The nitrogen source for ammonia was verified by GC-MS. O-phenylphenol was used in a modified version of the ammonia quantification reaction with $^{15}N$ labelled and natural ammonia to form hexanol-soluble dye. The dye was silylated to facilitate separation and analyzed via GC/MS (Agilent 7890A/5975C inert XL GC-MS with Restek Rtx-5MS w/Integra-Guard column).

Example 6: Results and Discussion

Figures 2A, 2B:
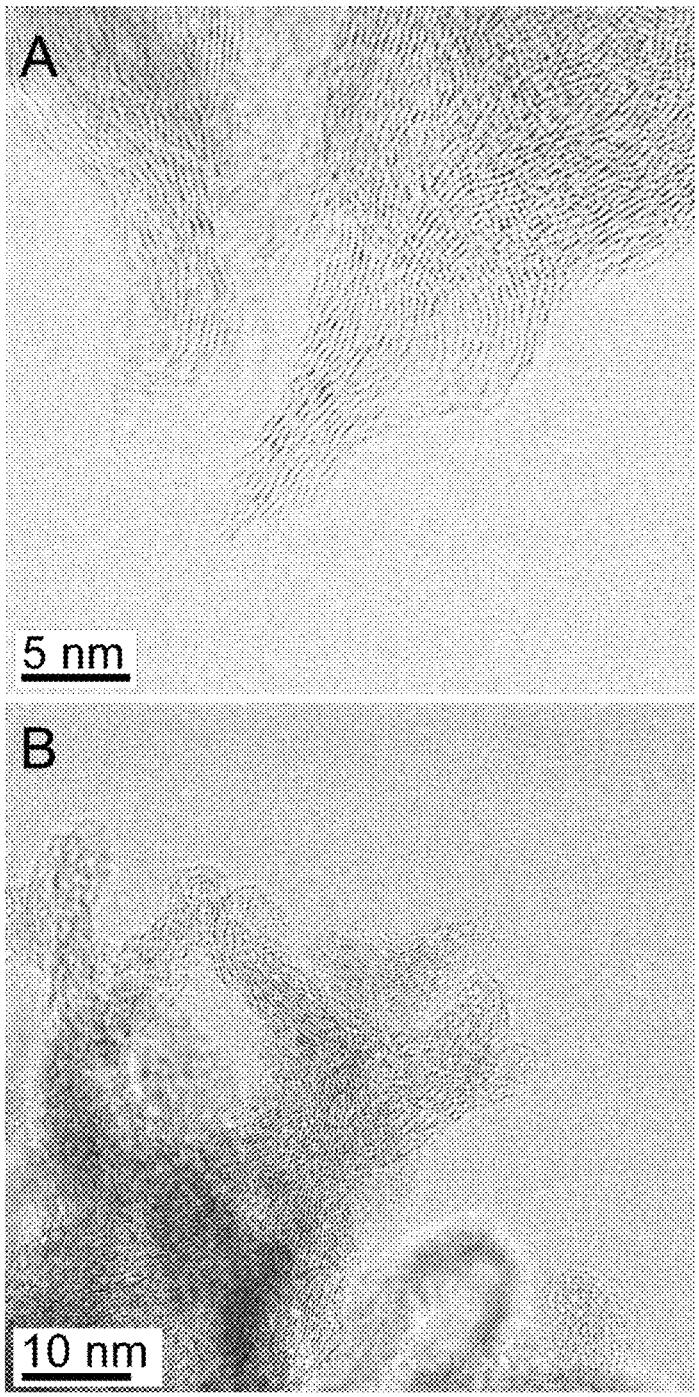
FIGS. 2A and 2B. Aberration-corrected STEM images of carbon nanospikes in (A) pristine and (B) O-etched states. (A) The pristine nanospikes exhibit layers of folded graphene with some structural disorder due to nitrogen incorporation in the basal plane. (B) O-etched CNS retains the layered graphene structure but exhibits a much larger radius at the tip, thereby lowering the local electric field present at the tips.

Unlike typical carbon electrode materials, the CNS surface features a unique morphology of abundant oriented nanospikes approximately 50-80 nm in length, where each nanospike consists of layers of carbon ending in a ~1 nm wide sharp tip (FIG. 2). We expected that the sharp tips in the CNS would dramatically amplify the local electric field.

Indeed, a simple estimate using an exohedral electric double-sphere capacitor model along with atomistic simulations for strongly curved surfaces with positive curvatures confirmed that the electric field at the tip's surface increases as the tip radius reduces. For a tip with a radius of 1 nm and a voltage drop of 1.8 V (potential difference between the polarized CNS electrode and the bulk electrolyte), the electric field on its surface enhances by 2 V/nm compared to that near a planar electrode surface. For smaller tip radii, the enhancement of electric field can be even stronger.

The possibility of utilizing the phenomenon of physical catalysis with a carbon-based electrode featuring sharp spikes and containing nitrogen doping but no metal elements for the electrocatalytic fixation of $N_2$ was investigated.

Electrochemistry was performed at ambient temperature and pressure, using CNS for the cathode and 0.25 M aqueous $LiClO_4$ solution for the electrolyte. $LiClO_4$ was chosen for its electrochemical stability, and because of enhanced interactions between $Li^+$ and $N_2$. Multiple controls were employed, including identical experiments on oxygen-plasma etched (O-etched) CNS that contained the same amount of nitrogen dopants as CNS but had the sharp tip texture fully etched away (FIG. 2B) so that it would not produce the same high electric fields as CNS. Glassy carbon was also chosen as a control because it lacked both nitrogen dopants and texture. Lastly, experiments were conducted with pristine CNS in argon-saturated electrolyte as a control.

Counterion effects were evaluated by comparison with other electrolytes containing $NaClO_4$ and $KClO_4$. Chronoamperometry (CA) measurements were conducted for 6 h each over a potential range of −0.79 to −1.29 V vs. RHE, a range based on the linear sweep voltammetry (LSV) profile. A new electrode was used for each measurement, and the ammonia product was quantified using a quantification protocol based on EPA Standard Method 350.1 (indophenol colorimetry. Stability was evaluated over 6-hour and 100-hour experiments. In all of the experiments the integrated current and partial current of ammonia formation is linear with time, which indicates that ammonia was produced continuously by the electrochemical reaction. The overall current density is stable at the highest production rate of the 100-hour experiment. The periodic noises were caused during sampling of the electrolyte to measure the rate of ammonia formation. The formation rate started at about ~90 $\mu g \cdot h^{-1} \cdot cm^{-2}$ at −1.19 V vs. RHE, and climbed to ~100 $\mu g \cdot h^{-1} \cdot cm^{-2}$ by 10 hours and remained at 100+/−5 for the remainder of the experiment. The total current density, which includes hydrogen evolution in addition to ammonia production, increased slightly up to 40 hours and then remained stable. This slight increase is possibly due to mild oxidation which increases wettability of the CNS surface.

Figure 3A:
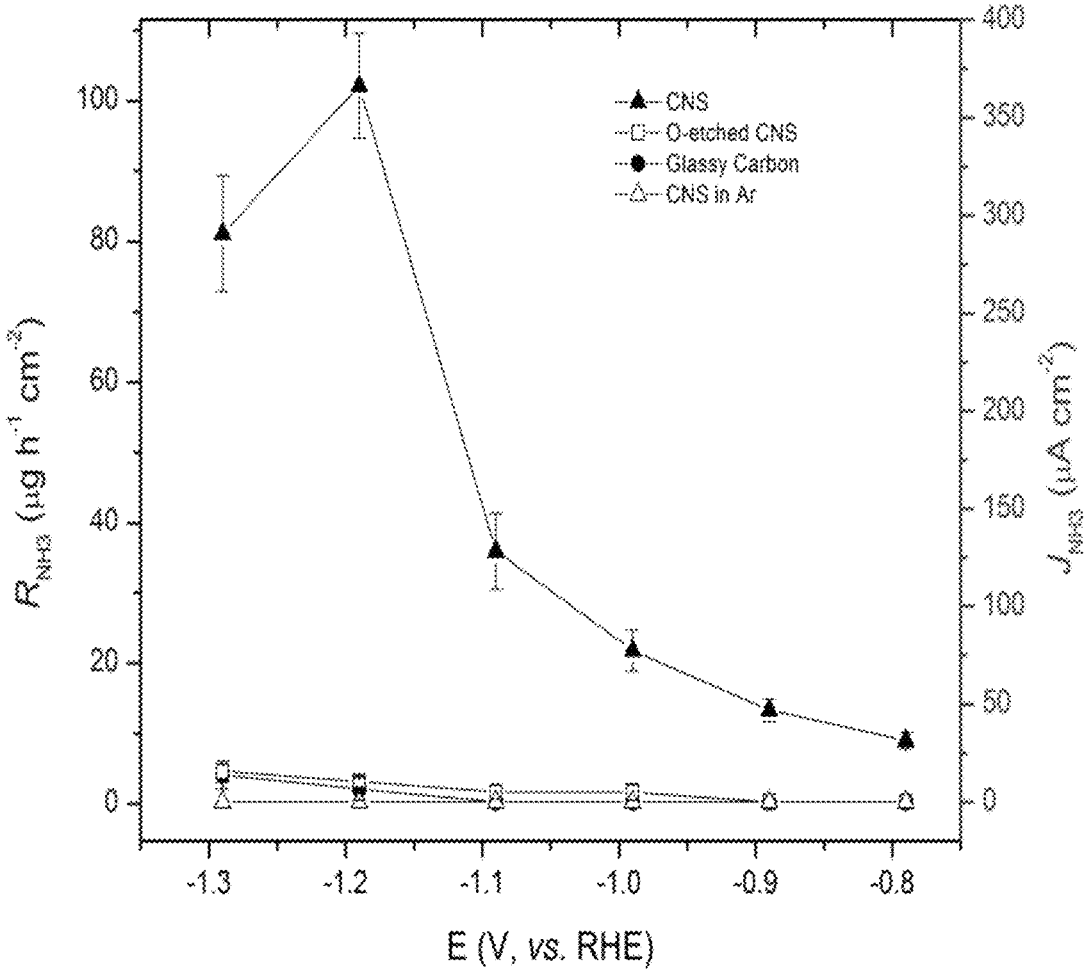
FIGS. 3A and 3B. The partial current densities and formation rate of ammonia normalized by the electrochemical surface area at various potentials in a range between −1.29 and −0.79 V using 0.25 M $LiClO_4$ electrolyte. (A) The CNS electrode in the presence of $N_2$ produced significant ammonia compared to O-etched CNS and glassy carbon controls, or to an argon gas experiment which produced no ammonia. The formation rate increased to −1.19 V above which hydrogen formation outcompeted ammonia formation. The Faradaic efficiencies (B) reflect the formation rates, with the highest efficiency of 9.25+/−0.67% at −1.19 V. For both (A) and (B), error bars represent the standard deviation of all measurements at that potential.
Figure 3B:
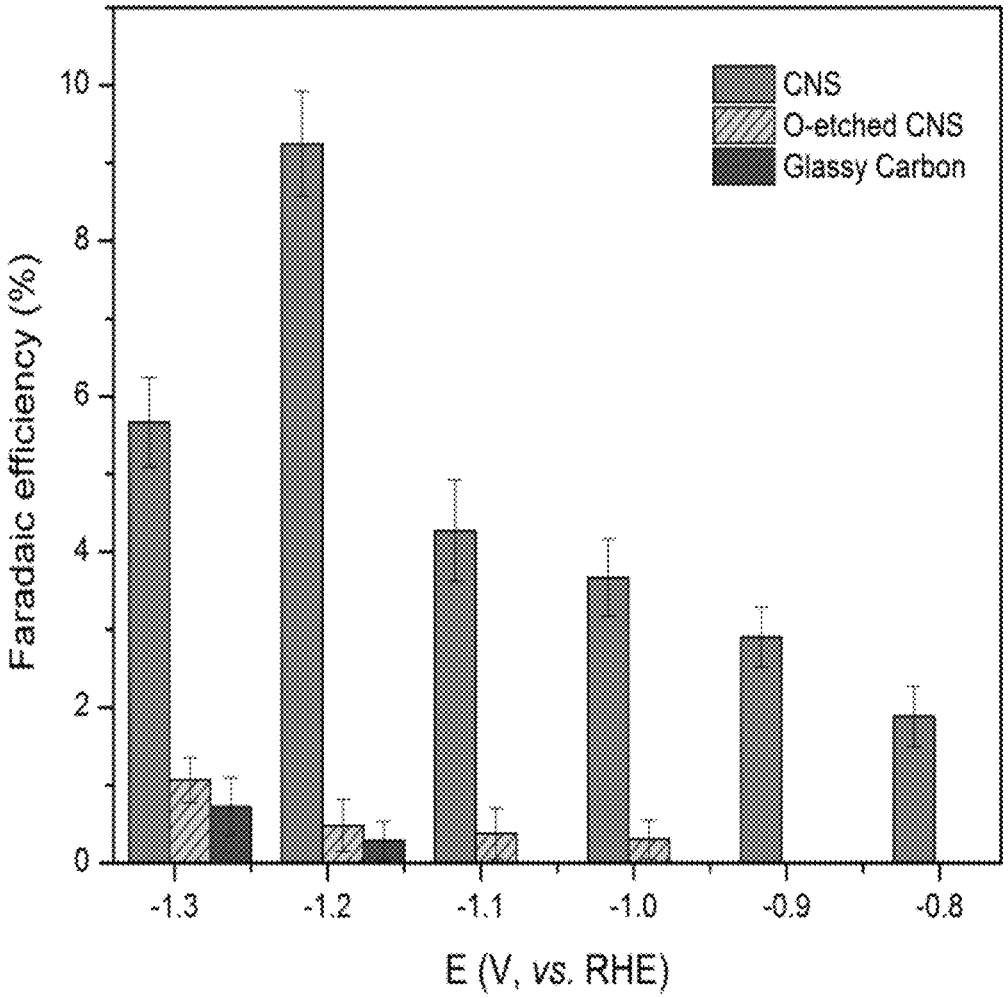

The rate of ammonia formation ($R_{NH3}$, FIG. 3A) on CNS increased with increasing negative potential to −1.19 V, where a maximum rate ($R_{NH3}$, 97.18 $\mu g \cdot h^{-1} \cdot cm^{-2}$) was achieved and above which the rate declined due to competitive formation of hydrogen gas. The Faradaic efficiency at −1.19 V is 9.25+/−0.67% (FIG. 3B), which is significantly higher than other aqueous electrochemical approaches albeit lower than that achieved by molten salt electrolysis. The three controls (O-etched CNS, glassy carbon, and Ar with CNS) produced very little or no ammonia at each voltage (FIGS. 3A and 3B). While the O-etched control has some texture (SEM), its reactivity is only slightly improved over the glassy carbon control. The sharp contrast between these two controls and the CNS indicates that the spike texture is much more important to the reactivity than the electrochemical surface area or the N-doping, consistent with our hypothesis that electroreduction of $N_2$ is driven by the strong electric fields derived from the sharp tips of the CNS. When $N_2$ gas is removed and replaced with argon then no ammonia is formed. CNS in $N_2$ experiments were performed at least 3 times, each with a new electrode, and six times for the critical potential of −1.19 V. It should be noted that the current densities are un-optimized and still much below that which would be required for commercial application.

Since nitrogen is required for the plasma-enhanced chemical vapor deposition (PECVD) synthesis of CNS, each CNS sample always contains approximately 5% N dopants. Although N-doping is not as critical as the texture for $N_2$ electroreduction, it functions to raise the Fermi level of the CNS above that of glassy carbon, thereby allowing $N_2$ reduction to proceed by a lower polarization $\Delta\phi$ on cathode (the difference between the electrode's initial potential $\phi_i$ and the polarized potential $\phi_p$). Indeed, the open-circuit potential for the unetched and O-etched CNS is −0.16 V lower than glassy carbon, reflecting the elevated Fermi level and accordingly the reduced work function of the N-doped materials compared to glassy carbon. It is generally understood that nitrogen doping leads to lowering the electron work function at the carbon/fluid interface.

The electrochemical reactions can be summarized in the following general scheme. On the cathode, $N_2$ is electrochemically reduced to ammonia in the presence of water:

$$N_2 + 6H_2O + 6e^- \rightarrow 2NH_3 + 6OH^- \quad (1)$$

On the anode, hydroxide is electrochemically oxidized to oxygen gas:

$$6OH^- \rightarrow 3/2O_2 + 3H_2O + 6e^- \quad (2)$$

The overall cell reaction is therefore:

$$N_2 + 3H_2O \rightarrow 2NH_3 + 3/2O_2 \quad (3)$$

Unlike the Haber-Bosch process, this reaction can be viewed as a competition for hydrogen between $N_2$ and $O_2$ leading to the formation of $NH_3$ going forward or $H_2O$ going backward. Since the forward reaction has a positive standard Gibbs energy change of $\Delta G^\circ$=+339.3 kJ/mol per mole of $NH_3$, the electroreduction of $N_2$ in water to form $NH_3$ is equivalent to an energy storage process.

For the reaction mechanism, $N_2$ reduction to ammonia on a heterogeneous surface can proceed by a dissociative or an associative mechanism. In the former case, the triple bond in $N_2$ is broken giving two surface-bound N atoms before hydrogenations take place. In the latter case, the $N_2$ molecule, usually adsorbed on a surface, can be hydrogenated without needing to break the triple bond in $N_2$. For $N_2$ fixation catalyzed by transition metal surfaces, e.g., in the Haber-Bosch process at high temperature, the reaction involves a dissociative mechanism whereby hydrogenation takes place on surface-bound N atoms. However, recent theoretical evaluations of electrocatalysts for $N_2$ reduction at ambient conditions indicated that the dissociative mechanism is only possible on early transition metals but impossible on late transition metals at room temperature. In comparison, the electrolysis on the CNS electrode takes place at room temperature in the absence of any transition metals. Therefore, it is reasonable to assume that the $N_2$ reduction on CNS should proceed according to an associative mechanism.

The difference in $NH_3$ formation rate between the unetched CNS and its two control electrode materials resides in the sharp spikes with tip size down to 1 nm. This prompts us to hypothesize a causality chain from the sharp spikes on CNS, the enhanced local electric field at the tip of CNS, the facilitated $N_2$ electroreduction, to the promoted ammonia production. Assuming an associative mechanism, the cathode reaction shown in eqn (1) for CNS should proceed through six sequential coupled electron and proton transfers from the electrode and electrolyte, respectively. Due to its inert nature, herein we explore the possibility of $N_2$ reduction at the first step, i.e. the first electron acquisition under a strong electric field. The influence of an electric field on $N_2$ molecule has been previously examined theoretically, showing that the polarization of $N_2$ in an external electric field leads to enhanced dipole moment, elongated bond length, and weakened bond strength. Further, the molecular orbital levels (e.g., $2\sigma_g$ and $2\sigma_u$ and also the remaining levels) of $N_2$ were found to decrease linearly with the strength of a longitudinal electric field. Such an observation is confirmed by our high-level electron propagator theory (EPT) calculations for a $N_2$ molecule in a longitudinal and transversal electric field of variable strengths. Although these calculations did not take solvation effect into account, the trends reflect profound implications for an enhanced reactivity of an otherwise inert $N_2$ molecule in the presence of the strong electric field. Based on $N_2$'s orbital levels calculated by EPT, and following Koopmans' theorem, it becomes energetically favorable to reduce $N_2$ by injecting electrons into the antibonding orbitals of $N_2$ under strong applied electric field. In comparison, the electric field induced by two of the controls, the O-etched CNS or the glassy carbon film electrode, will be much weaker and therefore not likely to facilitate the electroreduction of $N_2$, limiting the ammonia production rate.

Figure 4A:
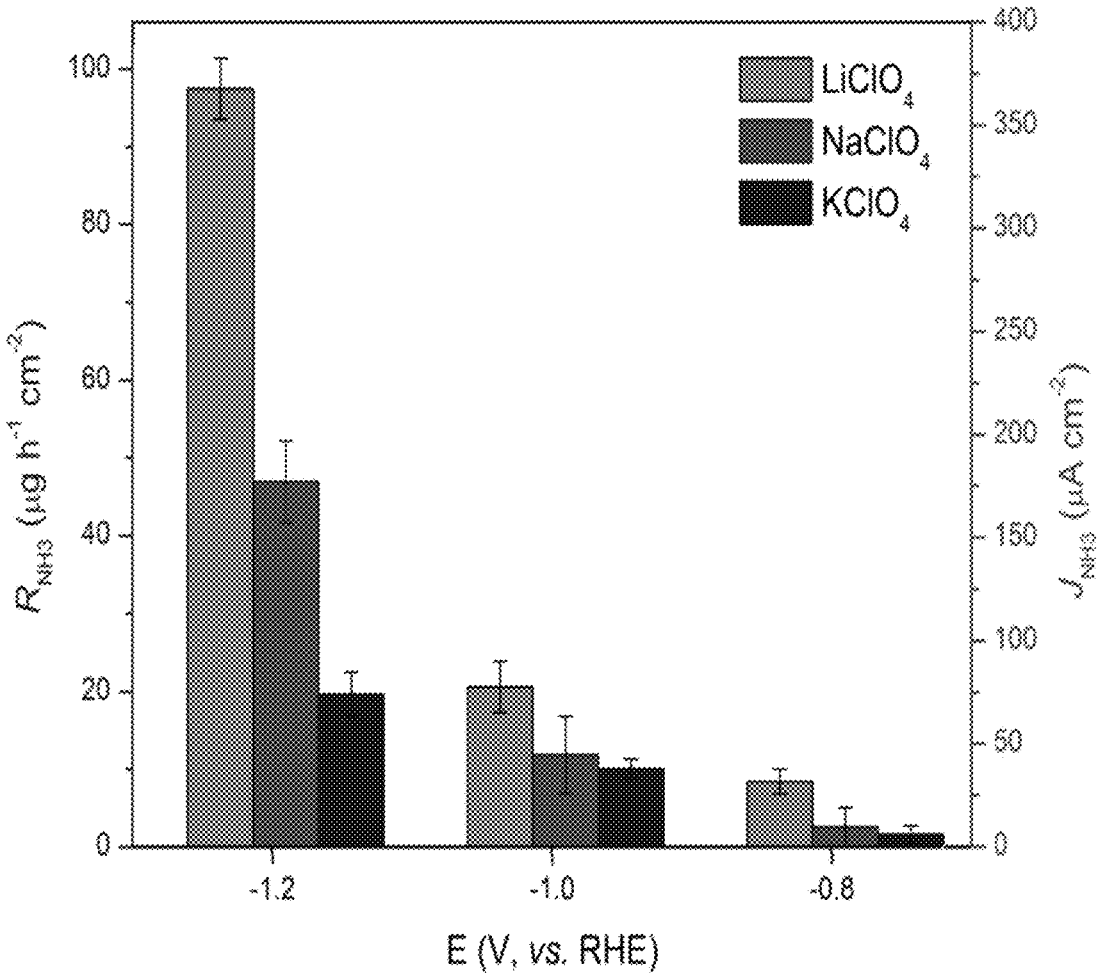
FIGS. 4A and 4B. (A) The formation rate and partial current and (B) Faradaic efficiency of ammonia formation with the presence of $Li^+$ (gray), $Na^+$ (red) and $K^+$ (blue) in the electrolyte at −1.19, −0.99, and −0.79 V, respectively. Faradaic efficiency of potassium sample is increased at −0.79 V due to a lower rate of hydrogen production.
Figure 4B:
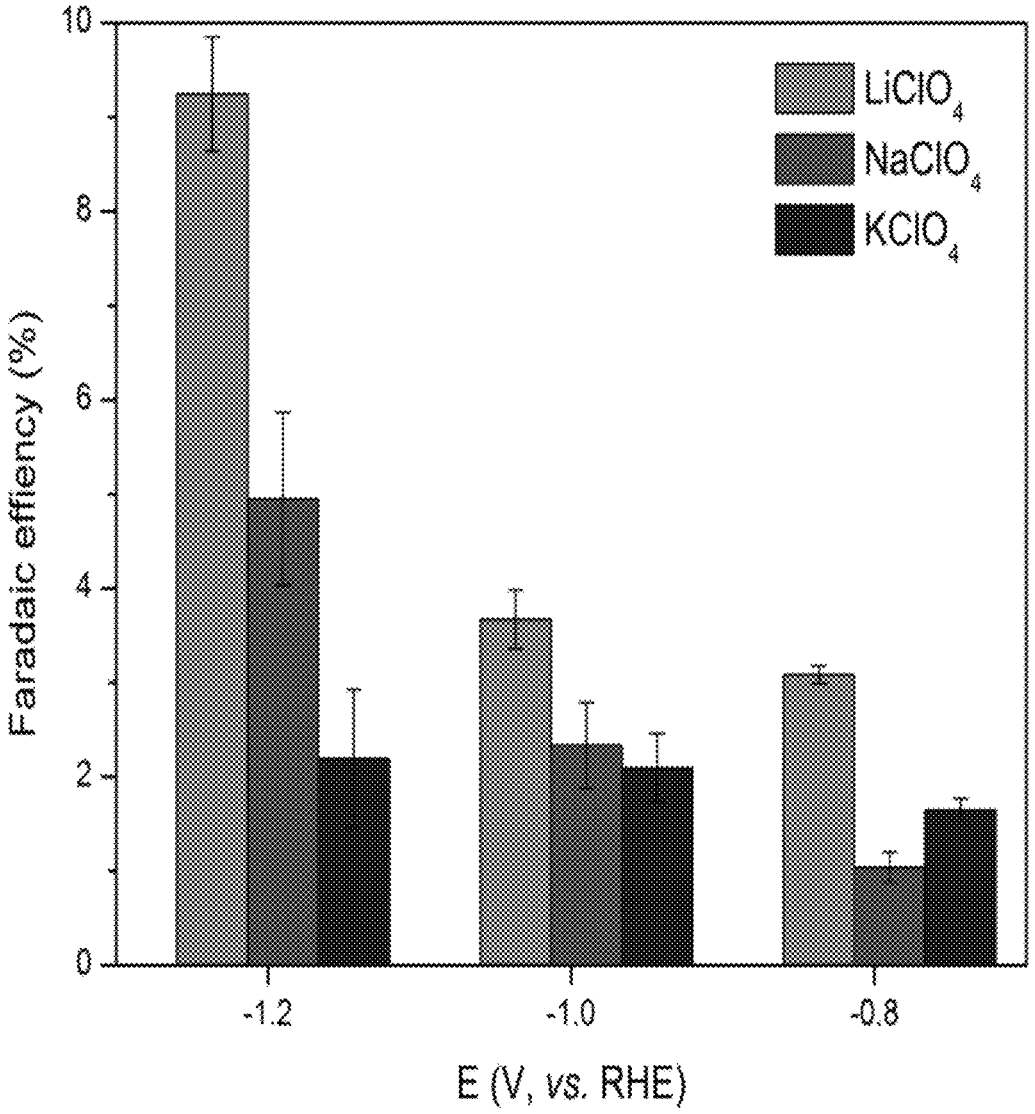

The role of electrolyte counterions was investigated by comparing $Li^+$, $Na^+$ and $K^+$ perchlorates. As shown in FIG. 4A, the formation rate ($R_{NH3}$) and partial current density ($J_{NH3}$) were the highest at all voltages for $Li^+$ and dropped with increasing cation size. FEs followed the same trend as formation rates (FIG. 4B), except at −0.79 V where the FE of $K^+$ was higher than $Na^+$ due to a much lower formation rate of $H_2$. This trend may be plausibly ascribed to the steric effect of the counterions and the relatively strong interaction between counterions and $N_2$. The size of counterions increases in the order of $Li^+<Na^+<K^+$. Using eqn. S2, it is straightforward to show that the electric field at the tip of the CNS surface increases with reducing counterion size, meaning that $Li^+$ is the best counterion in enhancing the electric field at the sharp spikes. In addition, the $Li^+$—$N_2$ interactions are reported for $N_2$ adsorption on $Li^+$ zeolites to have a binding energy on the order of 10 kcal/mol which was ascribed to the interaction between $Li^+$ and the strong quadrupole moment of $N_2$. The stronger adsorption of $N_2$ than $O_2$ over $Li^+$ in zeolites is exploited for the separation of $N_2$ from air. The binding energies of alkali metal ions with $N_2$ in the gas phase follow the order $\Delta E(Li^+)>\Delta E(Na^+)>\Delta E(K^+)$. One of the limitations in nitrogen electrochemical conversion in aqueous electrolyte is the low solubility of $N_2$ in water. We hypothesize that the $Li^+$ cations electrostatically enriched in the Stern layer interact with the dissolved $N_2$ molecules in a similar manner, to provide higher concentrations of $N_2$ at the electrode surface than in the electrolyte. This does not, however, preclude the alternative possibility that counterions interact with $N_2$'s induced dipole moment. The positive correlation in FIG. 4 suggests that the smaller counterions may enhance the electric field in the Stern layer and increase the association between counterions and $N_2$ molecules, both of which promote the $N_2$ reactivity in a concerted way. It is essential to understand the solvation effects on both counterions and $N_2$ molecules in future studies.

To simulate the electric double layers at the tip of a CNS, we adopt a simulation system. A carbon nanosphere with a radius of 1.0 nm is used to mimic the sharp tip of a CNS. The molecular dynamics simulations reveal a hybrid and complicated double-layer structure. The surface charges on the carbon nanosphere are screened partly by a layer of solvated $Li^+$ counterions located at ca. 0.36 nm from the carbon surface and also partly by a layer of desolvated $Li^+$ counterions located at ca. 0.20 nm from the carbon surface. Therefore, the effective thickness of the electric double layer is between 0.2 and 0.36 nm. The desolvated $Li^+$ counterion layer may serve to restrict the approach of water molecules to the electrode surface in order to reduce competitive hydrogen evolution reaction, thereby raising the FE.

The CNS are doped with N atoms at approximately 5%, so to rule out the possibility that $NH_3$ was produced from N dopant in the CNS catalyst rather than $N_2$ gas, two control experiments were carried out. First, a six-hour electroreduction with argon gas rather than $N_2$ yielded no ammonia formation. Second, a six-hour electrochemical reduction fed with 98% $^{15}N$ enriched $N_2$ gas (alongside a control of $^{14}N_2$ gas) was conducted, followed by the quantification of $^{15}NH_3$ and $^{14}NH_3$ with a phenylphenol ammonia quantification protocol. Subsequent trimethylsilyl (TMS) derivatization followed by GC-MS analysis identified two major silylated products from natural $^{14}N$ and enriched $^{15}N$, corresponding to double and triple silylation. The fragmentation patterns were identical, except that for $^{15}N$ product, the $^{15}N$-containing fragments were shifted by +1 m/z (mass-to-charge ratio) compared to $^{14}N$ fragments. The ratios of the integrated areas of the molecular ion of the enriched vs. natural abundance m/z increased from 0.56 to 48.73 for the triple-silylated product and from 0.47 to 9.43 for the more abundant double-silylated product. From these experiments we conclude that the ammonia produced by this reaction is entirely from dissolved $N_2$, not from N liberated from the CNS.

In summary, the electrochemical reduction of inert $N_2$ to ammonia by using N-doped CNS as the active electrode material was demonstrated. Due to the absence of transition metals on CNS, the reaction should be promoted through a physical mechanism associated with the enhanced electric fields arising from the sharp texture. This is supported by the O-etched CNS control experiment in which the blunt tips produce little ammonia under the same electrochemical conditions. The choice of counterions in the aqueous electrolyte is also critically important, with the ammonia production rates in the order of $Li^+<Na^+<K^+$, suggesting a favorable role for the smallest counterions in enhancing the electric field at the sharp spikes and increasing $N_2$ concentration within the Stern layer. Additionally, the evolution of $H_2$ gas is suppressed by the formation of a dehydrated cation layer surrounding the tip, which helps to exclude water while allowing access of $N_2$ molecule to the high electric field. Although further details remain to be elucidated in order to fully understand this reaction mechanism, including the energetics of electron injection to $N_2$, solvation of both counterions and $N_2$, elementary reaction steps, and the electric double layer structure with $Li^+$ and $N_2$ enrichment, this work establishes a viable physical catalyst for electrolysis of $N_2$ to ammonia.

What is claimed is:

1. A method of converting nitrogen into ammonia, the method comprising contacting an electrocatalyst with an aqueous solution of dissolved nitrogen gas, said electrocatalyst is electrically powered as a cathode and is in electrical communication with a counter electrode electrically powered as an anode, wherein a voltage across said cathode and said anode is within a range of 2 to 4 volts, to convert said dissolved nitrogen gas into ammonia; wherein said electrocatalyst comprises carbon nanospikes doped with nitrogen.

2. The method of claim 1, wherein said electrocatalyst is housed in a first compartment of an electrochemical cell, wherein said first compartment contains said aqueous solution in contact with said electrocatalyst; said counter electrode is housed in a second compartment of said electrochemical cell, wherein said second compartment also contains said aqueous solution.

3. The method of claim 1, wherein said carbon nanospikes contain layers of puckered carbon.

4. The method of claim 1, wherein at least a portion of the carbon nanospikes contain a straight or curled tip.

5. The method of claim 4, wherein said straight or curled tip has a width ranging from 0.5 nm to 3 nm.

6. The method of claim 1, wherein said carbon nanospikes have a length ranging from 20 nm to 100 nm.

* * * * *